US005263528A

United States Patent [19]

Patel

[11] Patent Number: 5,263,528

[45] Date of Patent: Nov. 23, 1993

[54] CORD LOCK

[75] Inventor: Bakulesh N. Patel, Charlotte, N.C.

[73] Assignee: CHF Industries, Charlotte, N.C.

[21] Appl. No.: 919,057

[22] Filed: Jul. 23, 1992

[51] Int. Cl.[5] ..... E06B 9/324

[52] U.S. Cl. ..... 160/178.2; 24/115 L; 24/136 A

[58] Field of Search ..... 160/178.2, 168.1, 173, 160/178.1; 24/136 A, 136 K, 115 L

[56] References Cited

U.S. PATENT DOCUMENTS 2,494,759 1/1975 Hirschy ..... 24/136 A
3,952,789 4/1976 Marotto .
4,180,118 12/1979 Vecchiarelli .
4,443,915 4/1984 Niemeyer ..... 160/178.2 X
4,651,795 3/1987 Valle et al. ..... 160/178.2
4,719,956 1/1988 Valle .
4,955,420 9/1990 Marinescu .
5,156,196 10/1992 Corey et al. ..... 160/178.2

*Primary Examiner*—David M. Purol
*Attorney, Agent, or Firm*—Lee, Mann, Smith, McWilliams, Sweeney & Ohlson

[57] ABSTRACT

The window blind cord lock disclosed has a pair of transverse cord accommodating channels which are angled downwardly from each other toward the outside of the cord lock. A fixed locking element and a moveable locking element are disposed selectively in one or the other of the channels, both being oriented substantially vertically upright. The angular disposition of these elements permits pendulum manipulation of the cords and prevents the cords from bunching up between the locking elements. The color coordinated cap covers the visible portions of the cord lock and is held in place by novel interlocking formations.

21 Claims, 2 Drawing Sheets

CORD LOCK

This invention relates to a cord lock for a window blind and, more particularly, to a cord lock having a low profile and which fits entirely within the body of the blind with no portions thereof extending laterally outward from the blind or downwardly from the headrail of the blind. The cord lock is rugged and has a minimum number of parts, is totally interchangeable from left to right and has a color cap which is securely attached and matches the blind.

BACKGROUND OF THE INVENTION

Venetian blinds and pleated blinds of modern design are frequently very thin and have a very slim, low profile headrail for accommodating the controlling cords of the blind. The cord locks which operate with these low profile headrails must match the profile of the headrail and not extend outside of the body of the blind or downwardly from the headrail. Such cord locks, nevertheless, must be capable of firmly locking the controlling cords of the blind in place without cutting or fraying of the cords, and they must be operable by pendulum manipulation of the cords from side-to-side. The cord locks must be interchangeable from left to right, and yet economy dictates that the cord locks have a minimum number of parts. It is, therefore, desirable that at least some of the movable parts be transferable from one side of the cord lock to the other when changing from left-hand to right-hand operation.

It is also desirable that the cord lock be capable of accommodating a colored cap which matches the coloring of the blind and headrail, and the cap must be firmly secured in place, so that it will not be dislodged even though it may be engaged and hit by the cords as they are being manipulated to raise or lower the blind. The cord lock constructed in accordance with the invention is adapted for either left-hand or right-hand operation with a simple reorientation of several parts of the mechanism and it may be quickly mounted in position on the headrail of the blind or shade.

SUMMARY OF THE INVENTION

In accordance with this invention a cord lock is provided for a window blind which has an elongated hollow headrail through which a plurality of cords extend for raising and lowering the blind. The cord lock includes a base member having a first body portion sized for insertion selectively into either end of the headrail, and this first body portion has a first or axial channel, which is preferably open at the top, for accommodating the cords. The cord lock base member has a second body portion having a pair of opposed cord-accommodating second or transverse channels which communicate with the axial channel and extend transversely and horizontally outwardly therefrom in opposite directions through the sides of the second body portion. A cover member extends across the top of the base member second body portion, and it forms the top wall of both transverse channels.

A fixed locking element, preferably a smooth pin, is mounted in fixed substantially vertically upright position within the associated transverse channel and at least one moveable locking element, preferably a knurled roller, is provided, and throughout its movement this moveable locking element is maintained in the same substantially vertically upright orientation as the fixed locking element. There are a pair of guide tracks within each of the transverse channels for guiding the movable locking element along a path within the associated transverse channel toward and away from the fixed locking element so that it may selectively grip or release the cords. The guide tracks within one of the transverse channels extends toward and may intersect the corresponding guide tracks within the other of the transverse channels, so that the moveable locking element may be moved into and be used selectively in either of the two opposed cord-accommodating transverse channels of the cord lock. It is preferred that the guide tracks be carved into the top and bottom walls of the transverse channels and that the movable locking element be a knurled locking roller having axle pins which ride in the top and bottom guide tracks within the transverse channels.

The substantially vertical orientation of the fixed and movable locking elements is essential because the cord lock must be operated by a sideways, pendulum manipulation of the cords.

One preferred feature of the cord lock is that the floor of the first or axial channel slopes downwardly from the center to the two outer edges of the channel, and this downward slope is continued in both the top and bottom walls of the second or transverse channels. In the axial channel this slope tends to keep the cords of the cord lock on the proper side of the axial channel.

In the transverse channels this slope provides an unexpected important benefit. The slight downward slope of the transverse channels causes the fixed and movable locking elements to be correspondingly angled or tilted from the vertical, while nevertheless remaining substantially vertically upright. The top end of each locking element will be disposed laterally outward from the bottom end. This assures that the cords will not bunch up on top of one another which can cause improper or inadequate gripping of the cords. Rather the cords will remain side-by-side on the slightly angled fixed locking element or pin so that each cord will be gripped uniformly between the fixed locking pin and the movable locking knurled roller. This uniform gripping of each of the cords prevents any of the cords from slipping after the cord locking has occurred.

Thus the locking roller, while remaining substantially upright, will move along an upwardly angled path toward the fixed locking element and down that angled path as it moves away from the fixed locking element. A horizontal pin is positioned at the outer bottom end of the horizontal channels for smoothly guiding the cords downwardly and permitting easy side-to-side, pendulum-like manipulation of the cords without abrading or cutting the cords.

A cap overlies the cover member and covers the side and end walls of the cover member and base member second body portion. The cap and the base member cooperate to define a space therebetween through which the cords may pass to the exterior of the cord lock. The cap is maintained in position by means of a first pair of interlocking formations on the cap and at least one of the members preventing relative vertical motion between the cap and the members and a second pair of interlocking formations on the cap and at least one of the members resists relative horizontal movement between the cap and the members so that the cap may be locked in place covering the exposed sides of the base members second body portion and the cover member. Means may be provided for firmly clamping a portion of the cap between cover and base members.

DETAILED DESCRIPTION OF THE PREFERRED EMBODIMENT

Figure 1:
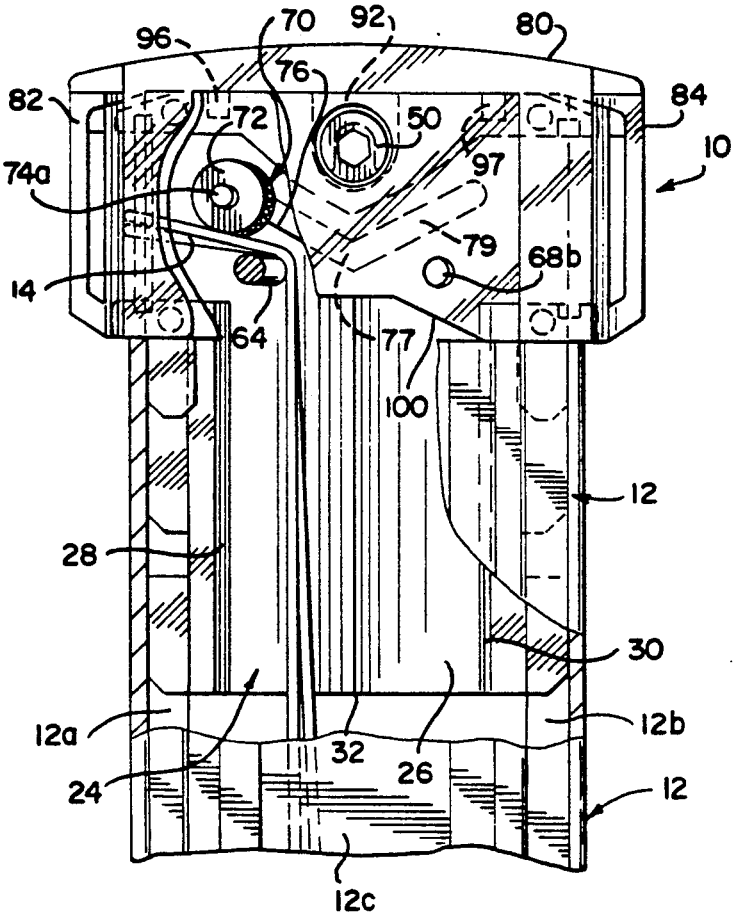
FIG. 1 is a top plan view, with portions broken away, of the cord lock constructed in accordance with this invention mounted on the left side of the headrail of a pleated blind or venetian blind.

The cord lock 10, shown in FIG. 1, is adapted to be inserted selectively into either end of an elongated hollow headrail 12 through which a plurality of cords 14 extend. The headrail 12 in this instance is a low profile headrail having the height of only about ½ inch and a width of less the 1½ inches.

Figure 2:
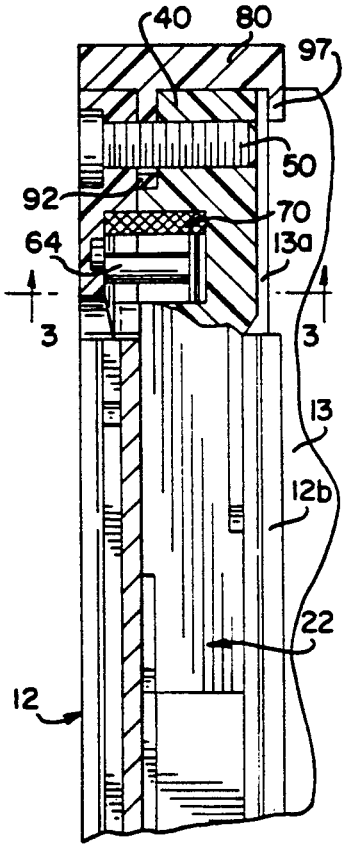
FIG. 2 is a side elevational view of the cord lock illustrated in FIG. 1, partially sectioned through the center of the cord lock.

The particular headrail illustrated in the drawings is open at its bottom, except for two opposed inwardly directed flanges 12*a* and 12*b* which support both the cord lock 10 and the top layer of fabric and stiffener 13*a* of a pleated shade or blind 13. A transverse web 12*c* extends across and joins the two sides of the headrail 12. In FIG. 1 the blind 13 and the fabric and stiffener 13*a* are broken away to show the flanges 12*a* and 12*b*, but the blind 15 and fabric and stiffener 13*a* are shown in FIG. 2. It will be noted that both the blind 13 and the fabric and stiffener 13*a* extend outwardly from the end of the headrail 12 and under the cord lock 10, and the fabric and stiffener 13*a* of the blind 13 are supported by the cord lock as will be further described.

The headrail 12 with the cord lock 10 partially inserted into it and partially extending outwardly therefrom (perhaps ¾ of an inch) are approximately the same width as the pleated window shade or blind 13.

Figure 4:
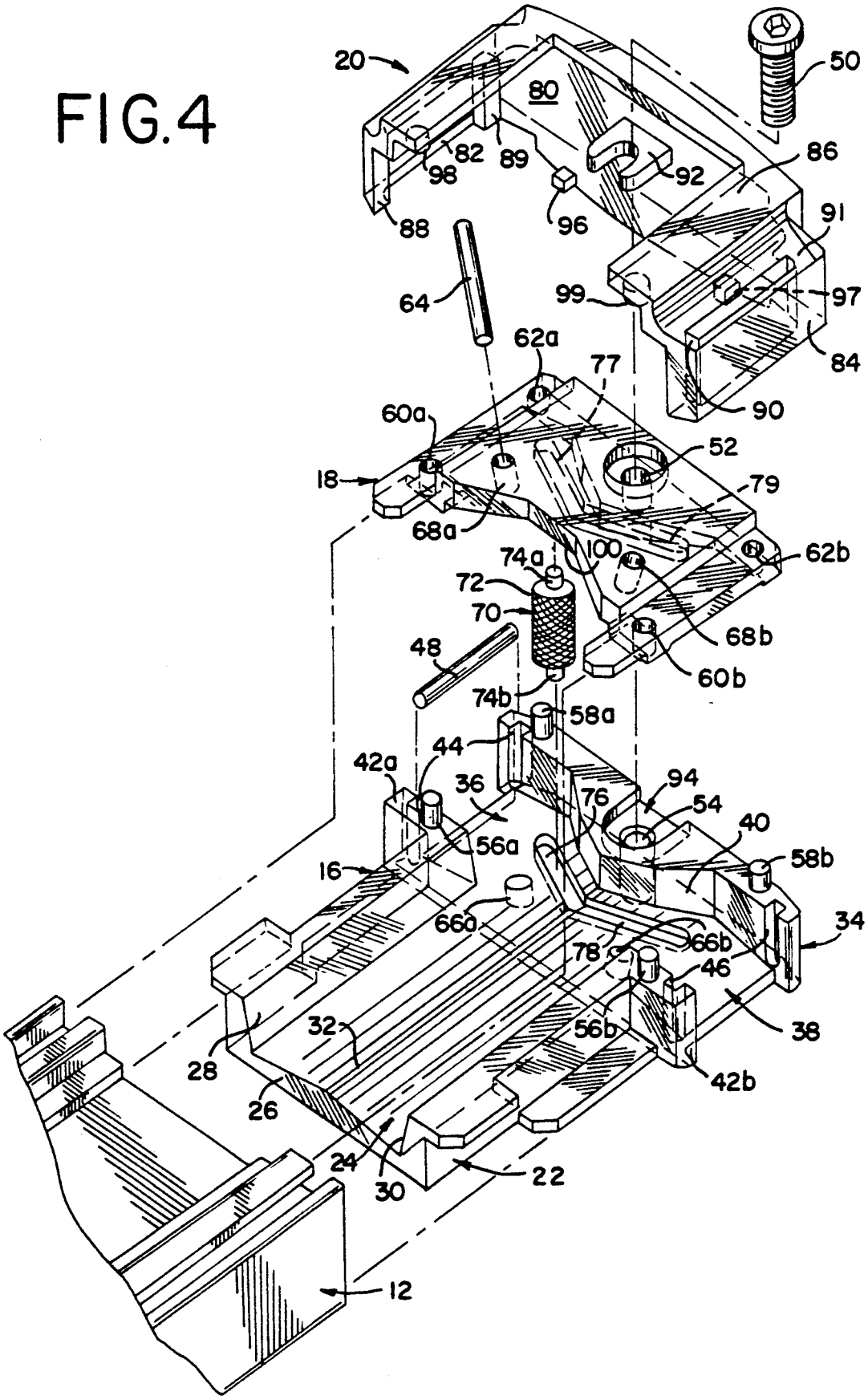
FIG. 4 is an exploded perspective view of the cord lock constructed in accordance with this invention.

As may be best seen in FIG. 4, which is an exploded view of the cord lock, the cord lock includes a base member 16, a cover member 18 and a cap 20. The base member 16 has at its inner end a first body portion 22 sized for insertion selectively into either end of the open-ended headrail 12. The first body portion 22 has a first channel 24 which is open at the top and is defined by a bottom wall 26 and a pair of side walls 28 and 30. The bottom wall 26 preferably slopes downwardly at approximately 10° from a center crest 32 to the bottoms of the two side walls 28 and 30.

The base member 16 at its outer end has a second body portion 34 which has a pair of opposed, cord-accommodating second or transverse channels 36 and 38 which are defined on the bottom by the extension of the downwardly sloping bottom wall 26 of the base member first body portion 22 and on the sides by the end wall 40 and the intermediate wall portions 42*a* and 42*b*. The crest of the bottom wall 26 extends into the second body portion of the base member and the slope of this bottom wall is the same in the second body portion 34 as it was in the first body portion 22. The transverse channels 36 and 38 thus extend through the side walls of the base member in the second body portion of the cord lock. Adjacent the outer ends of the transverse channels 36 and 38 in the end wall 40 and the intermediate wall portions 42*a* and 42*b* are slot pairs 44 and 46 into which a horizontal pin 48 is adapted to fit.

The cover member 18 overlies and forms the top wall of the two transverse channels 36 and 38. The cover member is held in place by suitable means. In the illustrated embodiment a cap screw 50 extends through a counter sunk hole 52 in the cover member and engages an internally threaded hole 54 in the end wall 40 of the base member second body portion 34. Cooperating with this threaded fastener connection are four upstanding pegs. Pegs 56*a* and 56*b* extend upwardly from and are integral with intermediate wall portions 42*a* and 42*b*, respectively, and pegs 58*a* and 58*b* extend upwardly from and are integral with the end wall 40 of the base member second body portion 34. These upstanding pegs extend into corresponding holes 60*a* and 60*b* and 62*a* and 62*b* in the cover member. It will be appreciated that various other means may be used to fasten the cover member 18 to the base member 16. The arrangement described and illustrated herein is advantageous from the standpoint of requiring only one threaded fastener 50 in order to assemble and disassemble these members.

The cord lock has a fixed locking element preferably in the form of a pin 64, one end of which is disposed in a hole 66*a* in the base member second body portion 34 and the other end of which is disposed in a corresponding hole 68*a* in the cover member 18. The holes 66*a* and 68*a* are located in the second or transverse channel 36 and corresponding holes 66*b* and 68*b* located respectively in the base member second body portion 34 and cover member 18 are adapted to accommodate the locking element or pin 64 in the other transverse channel 38 when that pin has been removed from the second channel 36. In other words, the pin 64 may be located in either the transverse channel 36 or the transverse channel 38 of the cord lock. If desired, of course, a second pin (not shown) may be employed and permanently fixed in place in the holes 66*b* and 68*b* of the transverse channel 36, so that it is not necessary to move one pin from one transverse channel to the other when changing the cord lock between right-hand and left-hand operation.

The cord lock has a movable locking element 70 having an enlarged knurled or otherwise roughened body 72, and a pair of short axle pins 74*a* and 74*b* extend outwardly from either end of the knurled body portion 72. A pair of linear guide tracks are disposed within each of the transverse channels 36 and 38 for guiding the moveable locking element 70 along a linear path within the associated transverse channel toward and away from the fixed locking element or pin 64 within that channel. In the preferred embodiment the guide track within the transverse channel 36 is formed by grooves 76 and 77 carved respectively in the bottom wall 26 of the base member second body portion 34 and the cover member 18. A corresponding set of grooves 78 and 79 are carved respectively in the bottom wall 26 of the base member second body portion 34 and cover member 18 within the other transverse channel 38. The guide track grooves 76–79 are adapted to accommodate the axle pins 74*a* and 74*b* of the movable locking element 70 and to guide that fixed locking element along a linear path defined by the grooves toward and away from the fixed locking element 64.

In the illustrated embodiment, the guide tracks formed by the grooves 77 and 79 in the cover member and the grooves 76 and 78 in the base member second body portion intersect one another at approximately the juncture of the base member first body portion 22 and the base member second body portion 34. This intersection of the guide tracks permits the moveable locking element 70 to be moved into and be used selectively in either of the two opposed cord-accommodating transverse channels 36 and 38 of the second body portion 34.

The cap 20 is intended to cover the side and outer end walls of the cover member 18 and the base member second body portion 34. The cap may be formed of a colored plastic which will match the color of the blind or shade with which the cord lock is used. While snap-on color coordinated caps have been used in connection with cord locks before this invention, none have employed the novel interlocking formations which positively prevent the dislodgement of the cap from the other portions of the cord lock during use. The cap 18 has an end wall 80 and a pair of side walls 82 and 84. A top wall 86 extends partially over the top, but it is preferred that the central portion of the top be open for purposes which will be apparent. A pair of spacers 88 and 89 are adapted to engage the outer edges of the second body portion intermediate wall 42*a* and end wall 40, respectively to space the side wall 82 of the cap outwardly from the entrance to the transverse second channel 36, and similar spacers 90 and 91 engage the intermediate wall 42*b* and opposite side of the end wall 40 of the base member second body portion 34 to space end wall 84 outwardly from the entrance to the other transverse second channel 38. This permits the operating cords of the blind or shade to pass upwardly between the end walls 82 and 84 of the cap and the entrances to the transverse channels 36 and 38, so that the cords may enter these channels of the cord lock.

In the preferred embodiment, the mounting of the cap 20 to the base member 16 and cover member 18 of the cord lock is accomplished by two pairs of interlocking formations. One of these formations is a substantially U-shaped tongue 92 which is molded integrally with and extends inwardly from the cap end wall 80. A corresponding recess 94 surrounds the threaded hole 54 in the end wall 40 of the base member second body portion 34, and this recess 94 is open at the top. The cover member 18 overlies this recess, and when the tongue 92 of the cap is inserted into this recess the threaded cap screw 50 may tighten the cover member 18 onto the top of the tongue 92 of the cap to firmly hold the cap in place within the recess. Access to the cap screw is through the central portion of the cap top wall 86.

While this is desired in certain instances, it is not necessary that the tongue 92 be clamped within this recess 94 between the cover member and the base member by the cap screw 50. The mere insertion of this formation 92 into the recess 94 in the base member below the cover member 18 will hold the cap 20 in place and prevent vertical movement thereof. Additional inwardly projecting formations 96 and 97 extend below and provide support for the outer end of the fabric and stiffener 13*a* extending from the headrail 12, as previously described and as best seen in FIG. 2. These formations, together with the fabric and stiffener inserted, tend to further stabilize and prevent rotational or vertical movement of the outer end of the cap 20. The end wall 80 of the cap 18 (from which the formations 96 and 97 extend) by its extension below the end wall 40 of the base member second body portion 34 acts as a stop to prevent lateral movement of the fabric and stiffener 13*a*.

At the inner end of the cap 20 and extending downwardly from the top wall 86 are a pair of projections 98 and 99 which are adapted to interfit with the upper ends of the holes 60*a* and 60*b* in the cover member 18, resiliently locking and resisting relative horizontal movement between the cap 20 and the other portions of the cord lock.

The guide tracks formed by the grooves 76–79 are angled inwardly toward the outer end of the first channel 24 where the first channel meets the two transverse channels 36 and 38, i.e. at the juncture of the first body portion 22 and second body portion 34. This guides the moveable locking element 70 between a position away from the fixed locking element 64, in which the cords 14 are released, and a position adjacent that fixed locking element, in which the cords may be gripped between these two elements. It is an important aspect of this invention that the locking elements be vertically disposed or substantially so. This is important because the cord lock is operated by moving the cords 14 from one side to another, selectively, to engage or release the knurled movable locking element 70. As the cords 14 pass outwardly through one of the transverse channels 36 or 38 (depending upon whether the cord lock is rigged for left-hand or right-hand operation) the cords extend over the horizontal pin 48 at the entrance to that transverse channel and then downwardly between the side wall of the cap 20 and the side of the base member 16.

Figure 3:
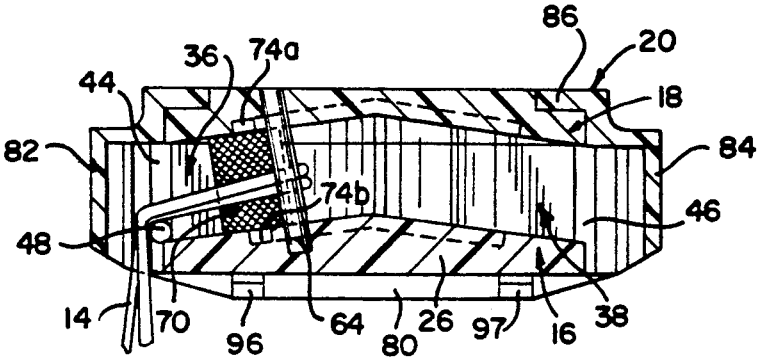
FIG. 3 is a sectional view taken substantially along lines 3—3 of FIG. 2.

The slight downward slope of the transverse channels 36 and 38, best illustrated in FIG. 3, is an important, highly preferred feature of the invention and permits the moveable locking element 70 to move easily to its outer position away from the fixed locking element 64 in which position the cords 14 are not operatively engaged by the locking elements of the cord lock. This also assures that the substantially vertical locking elements 64 and 70 will also be slightly inclined. Accordingly, the cords 14 will not bunch up on the top of one another causing inadequate or uneven gripping. Just a 10° angling from the vertical causes the cords 14 to remain side-by-side on the lightly angled fixed locking element. In order to engage the cords, the cords are moved laterally to engage the moveable locking element 70 and a slight release of the cords will move the moveable locking element 70 inwardly up the sloping transverse channel until it pinches the cords against the fixed locking element 64 to lock the cords in position. The cords may be released by pulling on the cords which moves the moveable locking element 70 outwardly down the sloping transverse channel and away from the fixed locking element 64. The cords then may be moved laterally away from the moveable locking element 70 and fully released.

While the illustrated embodiment employs only one fixed locking element 64 and one horizontal pin 48, it may be desirable to employ two fixed locking elements 64 and two horizontal pins 48 so that these parts do not have to be moved from one position to the other to change from right-hand to left-hand operation. With two fixed locking elements 64 and two horizontal pins 48 all that has to be done to change the moveable locking element 70 from left-hand to right-hand operation is to move that locking element past the fixed locking element 64 in the particular transverse channel in which it is positioned and into the intersecting guide track in the other transverse channel. In order to facilitate this it is preferred that there be a recess 100 at the inner end of the cover member 18 so that the moveable locking member 70 may be manipulated easily between the guide track of the transverse channels 36 and 38. This recess also permits the cords 14 to be inserted between the fixed and movable locking elements 64 and 70 in one of the transverse channels 36 or 38, depending upon whether the cord lock is being rigged for right-hand or left-hand operation.

The cap 20 has been described and illustrated as a separate part. However, if desired the cap 20 and cover member 18 may be a single unitary member affixed to the base member 16 by a fastener such as a cap screw 50. However, that is not preferred because it would make it much more difficult to insert the cords through the cord lock, and the purpose of the cover member is to have the visible exterior portion of the cord lock color coordinated with the blind.

While the foregoing description has been given by way of example, numerous modifications may be made in the specific structure illustrated without departing from the spirit and scope of the invention as hereinafter claimed.

What is claimed is:

1. A cord lock for a window blind having an elongate hollow headrail through which a plurality of cords extend for raising and lowering the blind, said cord lock including a first body portion sized for insertion selectively into either end of the headrail and having a central first channel for accommodating the cords, a second body portion having a pair of opposed cord-accommodating second channels communicating with said central first channel and extending transversely and horizontally outwardly from opposite sides of said central first channel through the sides of said second body portion, a fixed locking element mounted in fixed position within an associated one of said second channels, at least one movable locking element, a pair of guide tracks within each of said second channels for guiding said movable locking element along a path within the associated second channel toward said fixed locking element to grip said cords between said fixed and movable locking elements and away from said fixed locking element to release said cords, the guide tracks of one of said second channels extending toward and intersecting with the guide tracks in the other of said second channels, whereby said movable locking element may be moved into and be used selectively in either of the two opposed cord-accommodating second channels of said second body portion.

2. The structure of claim 1 wherein said fixed locking element is a substantially vertically oriented pin.

3. The structure of claim 1 wherein said movable locking element is a roller having a roughened surface.

4. The structure of claim 1 wherein said second channels have top and bottom channel-defining walls into which said guide tracks are carved, and said movable locking element is a substantially vertically oriented locking roller having a substantially cylindrical central portion and aligned axle pins on either end defining the axis of said locking roller, said locking roller axle pins being disposed for sliding movement within said guide tracks.

5. The structure of claim 4 wherein the space between said second channel top and bottom walls is just slightly larger than the locking roller cylindrical central portion, whereby said locking roller is prevented from tipping as it is moved along said guide tracks.

6. A cord lock for a window blind having an elongate hollow headrail through which a plurality of cords extend for raising and lowering the blind, said cord lock including a first body portion sized for insertion selectively into either end of the headrail and having a substantially horizontal first channel for accommodating the cords; a second body portion having a pair of opposed substantially horizontal cord-accommodating second channels communicating with said first channel and extending transversely outwardly in opposite directions therefrom through the sides of said second body portion, said second channels having top, bottom and side channel-defining walls, a pair of substantially vertically oriented fixed locking elements, each mounted in fixed position within an associated one of said second channels; at least one substantially vertically oriented movable locking element in the form of a locking roller having aligned axle pins on either end defining the axis of said locking roller; a pair of channel guide tracks carved into the top and bottom walls of each of said second channels for slidingly accommodating the axle pins of said locking roller and for guiding said locking roller along an axially upright path within the second channels for movement toward said fixed locking element to grip said cords and lock them against movement through said cord lock and for movement away from said fixed locking element to release said cords.

7. The structure of claim 6 wherein said second channels extend through the sides of said second body side portion at a level above the bottom of the headrail.

8. The structure of claim 6 wherein said fixed and movable locking elements are slightly tilted from the vertical with the top end of each locking element disposed laterally outwardly from the bottom end.

9. The structure of claim 6 wherein said cord lock second body portion forms an extension of the headrail with the top, bottom and sides thereof substantially aligned with the top, bottom and sides of the headrail.

10. The structure of claim 6 wherein said top and bottom walls of each of said second channels are angled downwardly and approximately 10° from the horizontal.

11. The structure of claim 6 and further including a substantially horizontal pin selectively positionable within one or the other of said second channels adjacent the juncture of said channel-defining bottom wall and the side of said second body portion, whereby the cords will extend over said horizontal pin and then downwardly therefrom.

12. The structure of claim 6 and further including a substantially horizontal pin disposed within each of said second channels adjacent the juncture of said channel-defining bottom wall and the side of said second body portion, whereby the cords will extend over said horizontal pin and then downwardly therefrom.

13. The structure of claim 6 wherein said channel guide tracks in with the top and bottom walls of said second channels interconnect, whereby said locking roller may be moved selectively from one of said second channels to the other.

14. A cord lock for a window blind having an elongate hollow headrail through which a plurality of cords extend for raising and lowering the blind, said cord lock including a base member having at its inner end a first body portion sized for insertion selectively into an end of the headrail, said first body portion having a first channel for accommodating the cords, said base member having at its outer end a second body portion having a pair of opposed cord-accommodating second channels communicating with said first channel and extending transversely outwardly in opposite directions therefrom through the sides of said second body portion, said second channels having bottom and side channel-defining walls, a cover member disposed in spaced overlying relationship with respect to said base member second body portion, thereby forming the top wall of said second channels, fixed locking means mounted in fixed position within at least one of said second channels, at least one movable locking element, a pair of linear guide tracks formed in said base member second body portion and said cover member within each of said second channels for guiding said movable locking element along a linear path within the associated second channel toward said fixed locking element to grip said cords and away from said fixed locking member to release said cords, and a cap overlying at least a portion of said cover member and covering the side and end walls of said cover member and said base member second body portion, said cap and said base member cooperating to define a downwardly open space therebetween through which the cords may pass to the exterior of the cord lock, a first pair of interlocking formations on said cap and at least one of said members for preventing relative vertical movement between said cap and said members, and a second pair of interlocking formations on said cap and at least one of said members for resisting relative horizontal movement between said cap and said members, whereby said cap may be locked in place covering the exposed sides of said base member second body portion and said cover member.

15. The structure of claim 14 and further including at least one substantially horizontal pin positioned within at least one of said second channels immediately adjacent the space defined by said base member and said cap, whereby the cords passing to the exterior of the cord lock will extend horizontally over said pin and then downwardly through the downwardly open space between said cap and said base member.

16. The structure of claim 14 wherein said first pair of interlocking formations are disposed adjacent the outer end of said base member cover member and cap.

17. The structure of claim 16 wherein said second pair of interlocking formations are disposed remote from said first pair of locking formations adjacent the juncture of said base member first and second body portions.

18. The structure of claim 17 wherein said first pair of interlocking formations include a tongue extending inwardly from said cap and a corresponding recess in at least one of said members, the length of said recess being such that said second pair of interlocking formations must be disengaged before said first pair of interlocking formations can be disengaged.

19. The structure of claim 18 and further including means for clamping said tongue between said cover member and said base member.

20. The structure of claim 14 wherein said second channel guide tracks extend toward one another and intersect adjacent the juncture of said base member first and second body portions, whereby said movable locking element may be moved into and be used selectively in either of the two opposed cord-accommodating second channels of said second body portion.

21. The structure of claim 14 wherein means is provided on said cord lock for receiving and for supporting an upper portion of the window blind.

* * * * *